US005530458A

United States Patent [19]

Wakasu

[11] Patent Number: 5,530,458

[45] Date of Patent: Jun. 25, 1996

[54] IMAGE MEMORY CONTROL DEVICE

[75] Inventor: Yutaka Wakasu, Tokyo, Japan

[73] Assignee: NEC Corporation, Tokyo, Japan

[21] Appl. No.: 281,684

[22] Filed: Jul. 28, 1994

[30] Foreign Application Priority Data

Jul. 29, 1993 [JP] Japan ..... 5-187936

[51] Int. Cl.[6] ..... G07G 5/00

[52] U.S. Cl. ..... 345/200; 345/115; 345/185

[58] Field of Search ..... 345/200, 201, 345/202, 203, 185, 115, 116, 145; 395/164, 166, 162, 425

[56] References Cited

U.S. PATENT DOCUMENTS

| | | | |
|---|---|---|---|
| 4,642,794 | 2/1987 | Lavelle et al. | 345/145 |
| 5,088,053 | 2/1992 | Sprague et al. | 345/202 |
| 5,293,623 | 3/1994 | Froniewski et al. | 395/425 |

FOREIGN PATENT DOCUMENTS 4-88634 3/1992 Japan .

*Primary Examiner*—Richard Hjerpe
*Assistant Examiner*—Steven J. Saras
*Attorney, Agent, or Firm*—Foley & Lardner

[57] ABSTRACT

An image memory control device is disclosed by which high speed reading processing can be performed without causing a CPU of a computer to have a waiting time and without expanding the system scale. When the CPU tries to perform read access to an image memory, a CPU read mode signal is changed over and a first-in first-out memory controller delivers a read access request to a memory access controller irrespective of presence or absence of read access, and data read in from the image memory are stored into a FIFO memory under the control of the memory controller. Upon read accessing from the computer, the data are transferred from the first-in first-out memory, which assures higher speed operation. Where writing of video data and read/write access of the computer to the image memory are performed by a same system, the FIFO memory is used as a common buffer to them in a time dividing condition by changing over between them.

4 Claims, 7 Drawing Sheets

| MODE | MEMORY ACCESS REQUEST REQUIREMENTS |
|---|---|
| WRITING OF VIDEO DATA | VIDEO DATA WRITE MODE AND THAT DATA NUMBER OF FIFO MEMORY IS NOT 0 |
| CPU WRITE ACCESS | CPU WRITE ACCESS MODE AND THAT DATA NUMBER OF FIFO MEMORY IS NOT 0 |
| CPU READ ACCESS | CPU READ ACCESS MODE AND THAT DATA NUMBER OF FIFO MEMORY DOES NOT EXCEED THRESHOLD LEVEL |

IMAGE MEMORY CONTROL DEVICE

BACKGROUND OF THE INVENTION

1. Field of the Invention

This invention relates to a control device for an image memory, and more particularly to an image memory control device wherein writing of video data into an image memory and read/write access of a computer to the image memory are performed in a same system.

2. Description of the Related Art

In recent years, image data processing systems wherein a video image is fetched into a computer to process the image data have been put into practical use.

In a system of the type mentioned, an analog video image is digitized and written into an image memory, and the data are fetched into and processed by a computer while the data are displayed on a monitor display unit of the computer so that the image information may be recognized by an operator. Accordingly, high speed memory access is required, and particularly it is required for the computer to read the memory at a high rate to fetch a necessary and sufficient amount of data into the computer in a unit time.

One of systems of the type described above is disclosed, for example, in Japanese Patent Laid-Open Application No. Heisei 4-88534 wherein, taking notice of the data structure wherein image data are inclined to gather in a particular area and are frequently stored cyclically into addresses of an image memory spaced by a fixed difference from each other, read access to the image memory is performed in the following manner to achieve high speed operation. In particular, read addresses demanded from a computer are successively supervised to detect a difference between the addresses, and a read address for a next cycle is predicted in accordance with the difference. Then, making use of a time within which the computer does not access, data are read out looking-ahead from the image memory based on the predicted read address and are stored into a register, and then, if an actual read address coincides with the predicted address, then the data of the register are transferred, but if they do not coincide with each other, reading of the image memory is performed again but based on the actual read address.

FIG. 10 illustrates the data processing condition of the system described above. In FIG. 10, the waveform (a) schematically illustrates access of the computer, and the waveform (b) schematically illustrates access of a memory controller. In the waveforms (a) and (b) of FIG. 10, reading of data from the image memory by the computer is indicated at T0, T2, T4 and T6, and look-ahead reading processing timings are indicated at T1, T3, T5 and T7. Thus, it can be seen from FIG. 10 that data read in looking-ahead making use of free times which do not interfere with the read timings T0, T2, T4 and T6 of the computer are stored into the data register.

With the system described above, however, no effect of high speed operation can be achieved with irregular image data which are stored at random in the image memory and do not allow prediction of the read address, and since reading processing of the computer and memory access of the memory access controller cannot be performed simultaneously as seen from FIG. 10, the computer has a waiting time. Further, in the system, while comparatively efficient read access can be performed where the processing speed of the CPU of the computer is low, the processing speed of the CPU in recent computers is improved, and in the case of a computer whose CPU has a high processing speed, wasteful waiting time is produced with the CPU.

SUMMARY OF THE INVENTION

It is an object of the present invention to provide an image memory control device by which high speed reading processing can be performed without causing a CPU of a computer to have a waiting time and without expanding the system scale.

In order to attain the object described above, according to the present invention, an image memory control device comprises a first-in first-out memory as a buffer between input digitized video data and an image memory and between a computer and the image memory. Image data are stored into the first-in first-out memory by looking-ahead in advance, and upon read accessing of the computer, the data stored in the first-in first-out memory are read out to allow continuous use of a high speed page mode of the image memory and achieve high speed writing of video data into the image memory and high speed accessing of the computer to the image memory. Further, writing of video data and read access and write access of the computer are selectively performed in response to a vertical synchronizing signal of the video signal to use the first-in first-out memory commonly to them in a time dividing condition thereby to suppress the scale of the buffer for which a large capacity is required and consequently reduce the scale of the system.

In a system wherein a video image is fetched into an image memory and the data are fetched into a computer, since successive rectangular picture images on the image memory are fetched, memory access and read access of looking-ahead data are performed varying the memory addresses by means of counters based on initial values and final values for an X direction and a Y direction.

Thus, in accordance with the present invention, there is provided an image memory control device which comprises mode change-over means for changing over an access mode to an image memory among a first access mode in which digitized video data are written into the image memory, a second access mode in which image data from a computer are written into the image memory, and a third access mode in which data stored in the image memory are read out in synchronism with a vertical synchronizing signal of a video signal in response to a mode selection signal from the computer, data select means operable in response to the access mode from the mode change-over means for selecting the digitized video data in the first access mode, selecting the image data from the computer in the second access mode and selecting the data read out from the image memory in the third access mode, a first-in first-out memory for storing the data selected by the data select means and for successively outputting the stored data in a first-in first-out fashion to the image memory in the first or second access mode but to the computer in the third access mode, address control means for producing addresses of the image memory for an X direction and a Y direction in accordance with address data received from the computer, memory access control means for accessing the image memory for data writing operation or data reading operation, and first-in first-out memory control means operable in response to the access mode from the mode change-over means for controlling, in the first access mode, the writing operation and the reading operation of the first-in first-out memory such that the video data selected by the data select means are written into the first-in first-out memory and then successively read out in a first-in first-out fashion from the first-in first-out memory and delivering a write access request to the memory access control means, for controlling, in the second access mode, the writing operation and the reading operation of the first-in first-out memory such that the image data from the computer selected by the data select means are written into the first-in first-out memory and then successively read out in a first-in first-out fashion from the first-in first-out memory and delivering a write access request to the memory access control means and for controlling, in the third access mode, the writing operation and the reading operation of the first-in first-out memory such that the read data from the image memory selected by the data select means are written into the first-in first-out memory and then successively read out in a first-in first-out fashion from the first-in first-out memory.

The first-in first-out control means may include a write counter for controlling the writing position of the first-in first-out memory, a first-in first-out memory write control circuit for producing a write control signal to the first-in first-out memory in accordance with a count value of the write counter, a read counter for controlling the reading position of the first-in first-out memory, a first-in first-out memory read control circuit for producing a read control signal designating the reading position of the first-in first-out memory in accordance with a count value of the read counter, an up-down counter for controlling the number of data stored in the first-in first-out memory, and a memory access request circuit for producing a memory write access request signal or a memory read access request signal to the memory access control means in response to a mode change-over signal from the mode change-over means and a count value of the up-down counter.

The image memory control device may further comprise an address register for storing the address data for the Y direction and the X direction outputted from the computer to access the image memory, and the address control means may include a pair of address counters for the Y direction and the X direction, loading control means for loading the address data for the Y direction stored in the address register into the address counter for the Y direction and for loading the address data for the X direction stored in the address register into the address counter for the X direction, counter control means for the Y direction and the X direction for incrementing the address counters for the Y direction and the X direction, respectively, in response to a count-up signal from the memory access control means, and an address selector for selecting one of an address for the Y direction from the address counter for the Y direction and an address for the X direction from the address counter for the X direction. In this instance, the address counter for the X direction increments its count value in response to the count-up signal from the memory access control means; the address counter for the Y direction increments its count value upon switching of a horizontal synchronizing signal in the first access mode or when the count value of the address counter for the X direction reaches its final value in the second or third access mode; upon switching of the vertical synchronizing signal, the address data for the Y direction and the X direction are loaded from the address register into the address counters for the Y direction and the X direction, respectively; in the first access mode, the address data for the X direction is loaded from the address register into the address counter for the X direction upon switching of the horizontal synchronizing signal; and in the second mode or the third mode, when the count value of the address counter for the X direction reaches its final value, the address data for the X direction is loaded from the address register into the address counter for the X direction.

With the image memory control device, due to the facts that, when the computer tries to read data of the image memory, a high speed page mode can be used continuously by looking-ahead of the data; that object data are stored already in the first-in first-out memory when the computer accesses first; that the high speed page mode can be used continuously until the number of data of the first-in first-out memory reaches its upper limit threshold level; and that the computer need not access the image memory directly but may access the first-in first-out memory, high speed reading processing can be achieved. Further, since the first-in first-out memory is commonly used in a time dividing condition for writing of video data and read access and write access of the computer, the scale of the buffer for which a large capacity is required can be suppressed and the scale of the system can be reduced.

The above and other objects, features and advantages of the present invention will become apparent from the following description and the appended claims, taken in conjunction with the accompanying drawings in which like parts or elements are denoted by like reference characters.

SUMMARY OF THE INVENTION

DESCRIPTION OF THE PREFERRED EMBODIMENT

Figure 4:
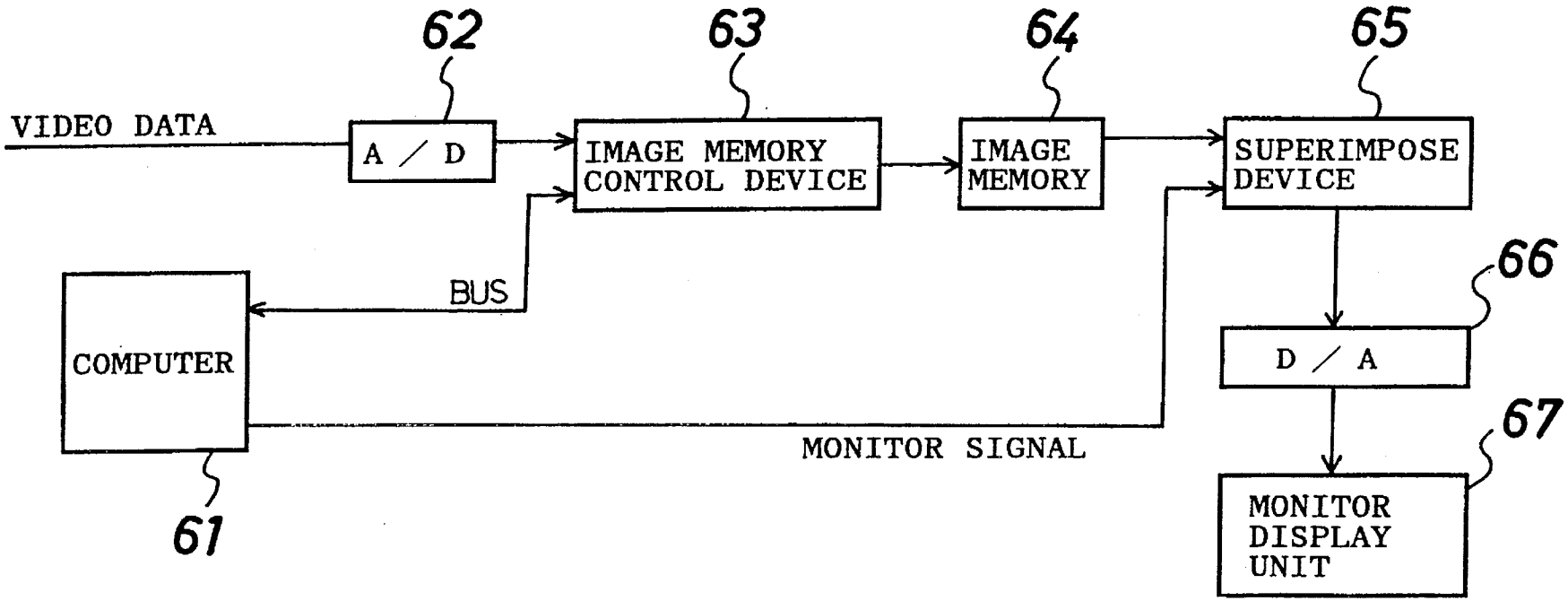
FIG. 4 is a block diagram showing a system in which an image memory control device according to the present invention is incorporated.

Referring first to FIG. 4, there is shown a system in which an image memory control device according to the present invention is incorporated. The system shown includes a computer 61 for controlling the entire system, an analog to digital (A/D) converter 62 for digitizing input analog video data, an image memory control device 63 connected to the computer 61 by way of a bus and constructed in accordance with the present invention, a dual port image memory 64, a superimpose device 65 for superimposing a monitor signal of the computer 61 such as, for example, a title of an image signal on image data of the image memory 64, a digital to analog (D/A) converter 66 for converting overlapped digital video data into analog video data, and a monitor display unit 67 for displaying video data from the digital to analog converter 66.

Figure 1:
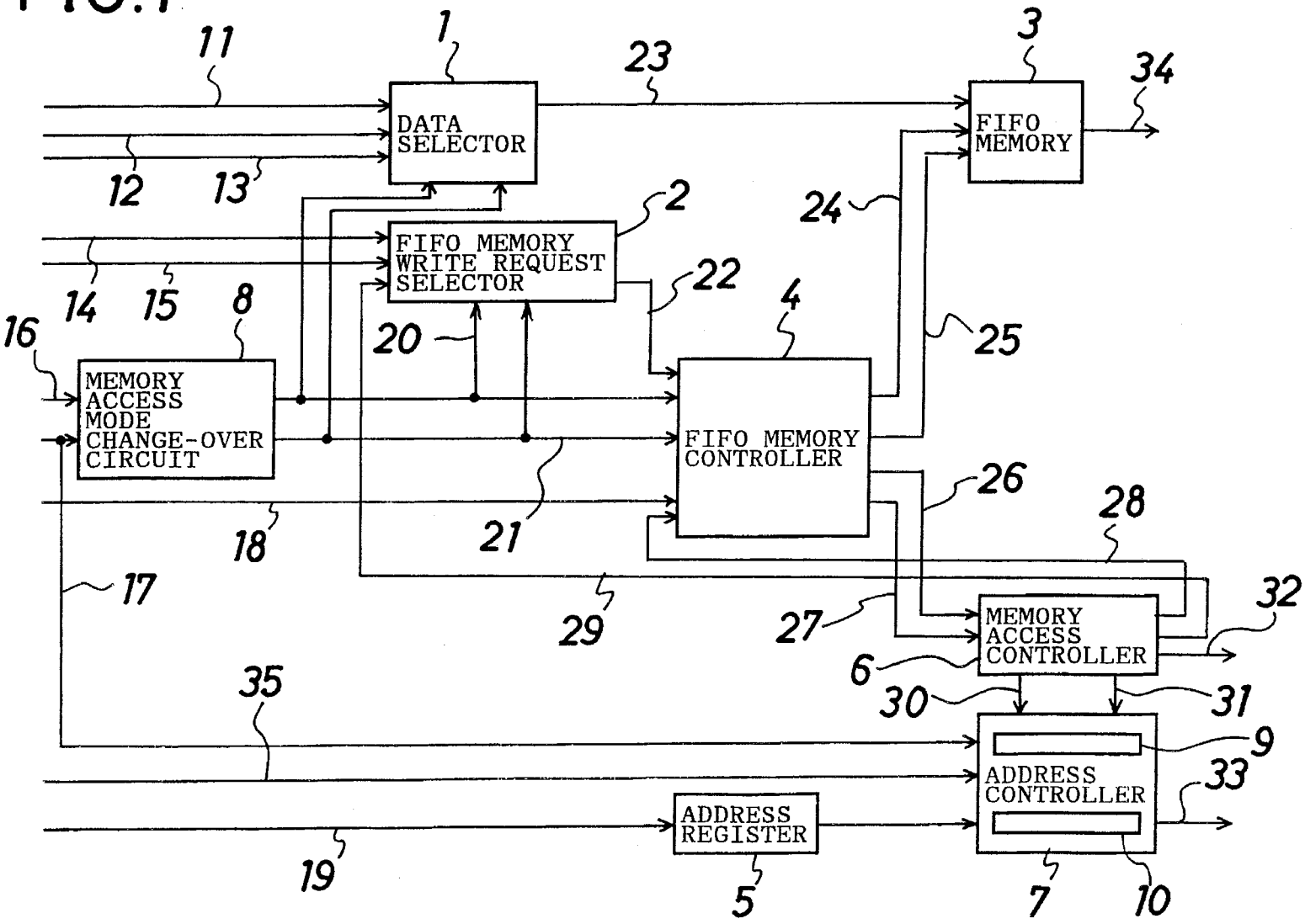
FIG. 1 is a block diagram of an image memory control device showing a preferred embodiment of the present invention.

The image memory control device 63 to which the present invention is applied controls video data digitized by the analog to digital converter 62 between the image memory 64 and the computer 61 and has such a construction as shown in FIG. 1. Referring now to FIG. 1, the image memory control device 63 includes a data selector 1 for selecting one of three data including digitized video data 12, CPU write data 13 from the computer 61 and memory read data 11 read in from the image memory 64, a FIFO memory write request selector 2 for selecting one of a video data write request signal 14, a CPU write request signal 15 and a one read access end signal 29 to produce a FIFO memory write request signal 22, a FIFO memory 3 for successively storing and outputting data 23 selected by the data selector 1, a memory access controller 6 for controlling access to the image memory 64, a FIFO memory controller 4 for controlling writing and reading of data into and from the FIFO memory 3 and for delivering a memory access request to the memory access controller 6, an address register 5 for storing access data 19 of initial values for accessing the image memory 64 in an X direction and a Y direction, an address controller 7 including a Y direction address counter 9 and an X direction address counter 10 for producing addresses of the image memory 64 for the Y direction and the X direction for accessing the image memory 64, and a memory access mode change-over circuit 8.

The memory access mode change-over circuit 8 outputs an access mode change-over signal 20 and a read/write change-over signal 21 for performing mode changing over in synchronism with a vertical synchronizing signal 17 of a video signal based on a mode select signal 16 from the computer 61. The two signals 20 and 21 are both inputted to the FIFO memory write request selector 2 and the FIFO memory controller 4. The data selector 1 inputs the three data 11, 12 and 13 described above and outputs write data 23 to the FIFO memory 3. The FIFO memory 3 outputs image data 34 to the computer 61 or the image memory 64. The FIFO memory controller 4 inputs the access mode change-over signal 20, the read/write change-over signal 21, a CPU read signal 18, the FIFO memory write request signal 22 and a one write access end signal 28, and outputs a FIFO memory write control signal 24, a FIFO memory read control signal 25, a memory write access request signal 26 and a memory read access request signal 27. The two control signals 24 and 25 are inputted to the FIFO memory 3, and the two access request signals 26 and 27 are inputted to the memory access controller 6. The memory access controller 6 outputs a one write access end signal 28, a one read access end signal 29, a count up signal 30, an address select signal 31, and a memory access signal 32 for accessing the image memory 64. The address controller 7 includes the Y direction address counter 9 and the X direction address counter 10 for counting address data from the address register 5, and controls the two counters in accordance with the vertical synchronizing signal 17 and controls the X direction address counter 10 in accordance with a horizontal synchronizing signal 35 to produce addresses 33 for the X direction and the Y direction for the image memory 64.

Figure 2:
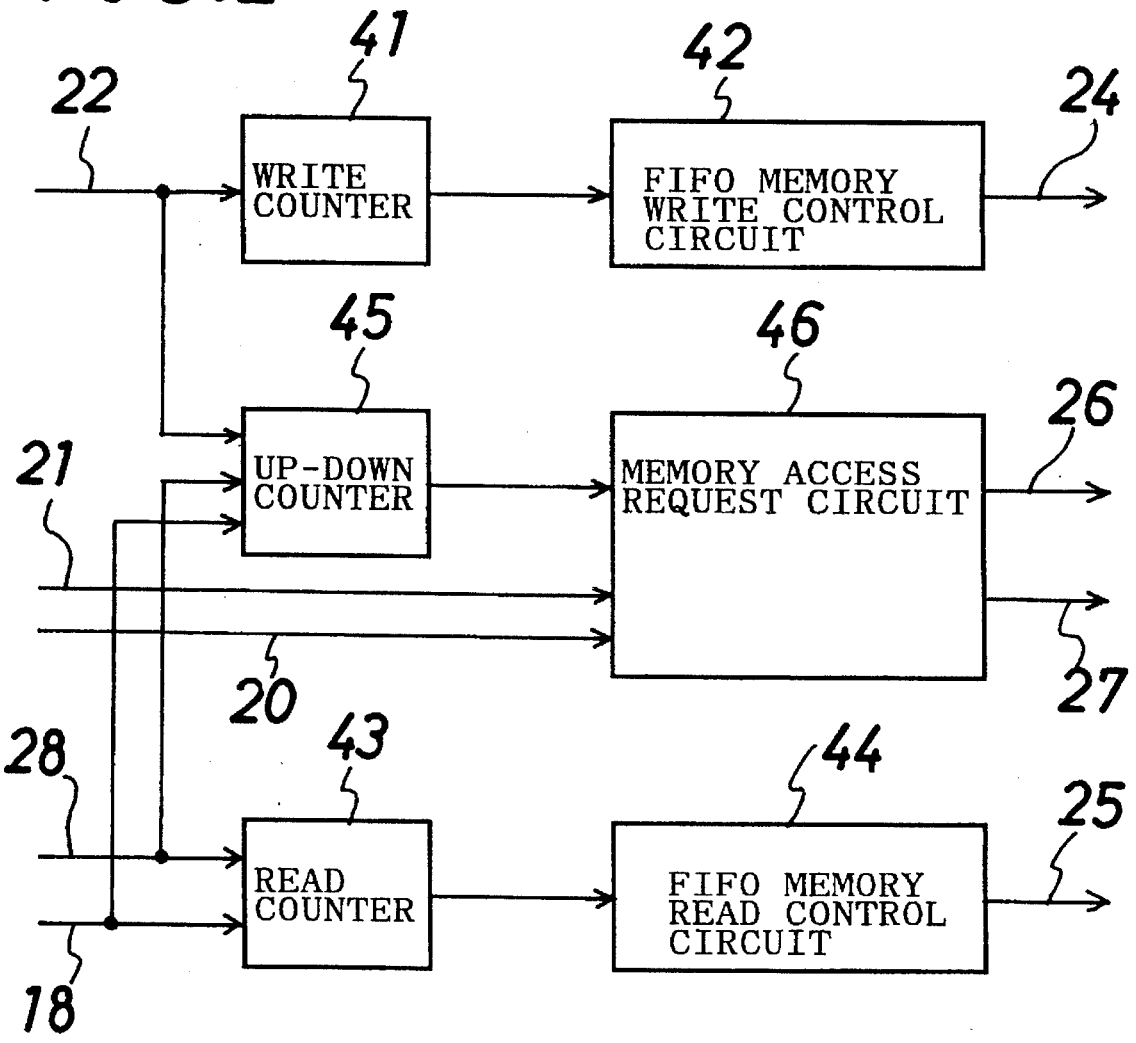
FIG. 2 is a detailed block diagram of a FIFO memory controller of the image memory control device shown in FIG. 1.

FIG. 2 shows details of the FIFO memory controller 4 shown in FIG. 1. Referring to FIG. 2, the FIFO memory controller 4 includes a write counter 41 for controlling the writing position of the FIFO memory 3, a FIFO memory write control circuit 42 for producing a FIFO memory write control signal 24 for the FIFO memory 3 in accordance with the count value of the write counter 41, a read counter 43 for controlling the reading position of the FIFO memory 3, a FIFO memory read control circuit 44 for producing a FIFO memory read control signal 25 for designating the reading position of the FIFO memory 3 in accordance with the count value of the read counter 43, an up-down counter 45 for controlling the number of data stored in the FIFO memory 3, and a memory access request circuit 46 for producing a memory write access request signal 26 or a memory read access request signal 27 for the memory access controller 6 in accordance with the access mode change-over signal 20, the read/write change-over signal 21, the FIFO memory write request signal 22 and the count value of the up-down counter 45.

Figure 3:
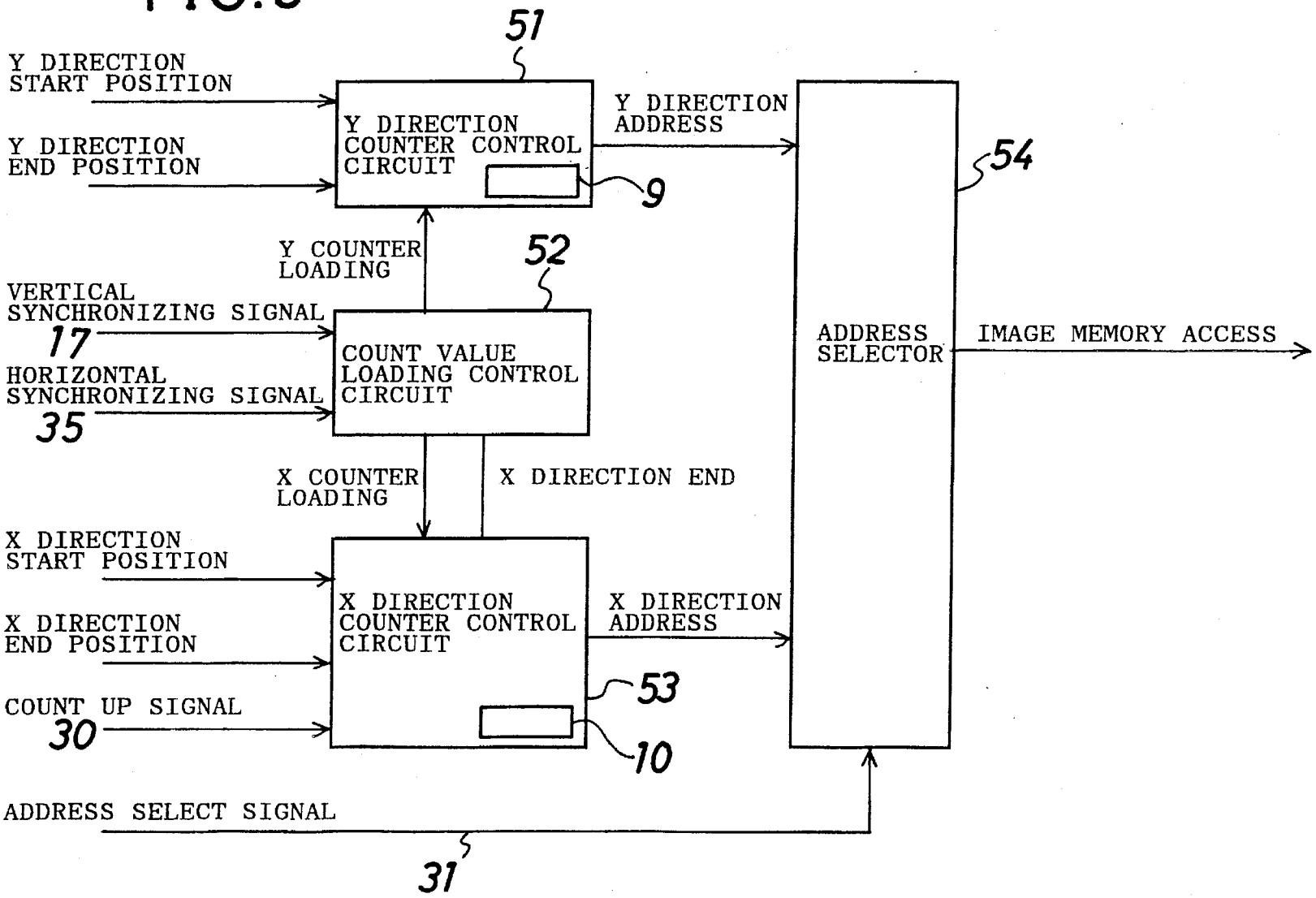
FIG. 3 is a detailed block diagram of an address controller of the image memory control device shown in FIG. 1.

FIG. 3 shows details of the address controller 7 shown in FIG. 1. Referring to FIG. 3, the address controller 7 includes a Y direction counter control circuit 51 and an X direction counter control circuit 53 including the address counters 9 and 10 for the Y and X directions mentioned hereinabove, respectively, a count value loading control circuit 52 for controlling loading of initial values into the Y direction address counter 9 and the X direction address counter 10, and an address selector 54 for selecting one of an address for the Y direction from the Y direction address counter 9 and an address for the X direction from the X direction address counter 10. The count value loading control circuit 52 controls loading of an initial value for the Y direction from the address register 5 into the Y direction address counter 9 and loading of an initial value for the X direction from the address register 5 into the X direction address counter 10 in the following manner.

In particular, upon switching of the vertical synchronizing signal 17, initial values for the Y and X direction are loaded from the address register 5 into the Y and X direction address counters 9 and 10, respectively. On the other hand, in a video data write mode, the initial value for the X direction is loaded from the address register 5 into the X direction address counter 10 upon switching of the horizontal synchronizing signal 35, but in a computer read access mode or a computer write access mode, the initial value for the X direction is loaded from the address register 5 into the X direction address counter 10 after the count value of the X direction address counter 10 reaches its final value.

An incrementing operation of the X direction address counter 10 takes place in response to the count up signal 30 from the memory access controller 6, and an incrementing operation of the Y direction address counter 9 takes place upon switching of the horizontal synchronizing signal 35 in a video data write mode but takes place after the count value of the X direction address counter 10 reaches its final value in a computer access mode. One of the address for the Y direction and the address for the X direction is selected in accordance with the address select signal 31 from the memory access controller 6 by the address selector 54.

Subsequently, operation of the image memory control device will be described.

First, operation upon writing of video data into the image memory 64 will be described. The computer 61 sets the access mode to the image memory 64 to the video data write mode.

Consequently, the data selector 1 is put into a condition wherein it selects the digitized video data 12, and the FIFO memory write request selector 2 is put into a condition wherein it selects the video data write request signal 14. The digitized video data 12 digitized by the analog to digital converter 62 and the video data write request signal 14 are rendered active, and the write counter 41 of the FIFO memory controller 4 increments its count value. Further, the FIFO memory write control circuit 42 outputs a FIFO memory write control signal 24 to the FIFO memory 3 in accordance with the count value of the write counter 41 to write the write data 23 (in this instance, digital video data) into the FIFO memory 3.

Meanwhile, also the up-down counter 45 of the FIFO memory controller 4 increments its count value, and the memory access request circuit 46 outputs a memory write access request signal 26 to the FIFO memory controller 4. The memory access controller 6 controls the count values of the X and Y direction address counters 10 and 9 in the address controller 7 in accordance with the address select signal 31 to effect write access to the image memory 64. Then, the memory access controller 6 outputs a one write access end signal 28 to the FIFO memory controller 4, and outputs to the address controller 7 a count up signal 30 for incrementing the X direction address counter 10. Meanwhile, the memory access controller 6 simultaneously controls the memory access signal 32. After the one write access end signal 28 becomes active, the read counter 43 increments its count value, and the FIFO memory read control circuit 44 updates the value of the FIFO memory read control signal 25.

Further, the up-down counter 45 decrements its count value in response to the one write access end signal 28 to update the number of data stored in the FIFO memory 3. Writing of video data into the FIFO memory 3 is successively performed independently of access to the image memory 64.

Subsequently, a writing operation into the image memory 64 will be described. The computer 61 places the access data 19 indicative of the accessing position of the image memory 64 into the address register 5 and sets the access mode to the image memory 64 to a CPU write mode. Consequently, the data selector 1 is put into a condition wherein it selects the CPU write data 13, and the FIFO memory write request selector 2 is put into a condition wherein it selects the CPU write request signal 15. Then, the computer 61 transfers write data to the image memory control device 63 by way of the bus.

The CPU write data 13 and the CPU write request signal 15 are rendered active, and the write counter 41 of the FIFO memory controller 4 increments its count value. The FIFO memory write control circuit 42 outputs a FIFO memory write control signal 24 in accordance with the count value of the write counter 41 to write the write data 23 (in this instance, CPU write data 13) into the FIFO memory 3.

Meanwhile, also the up-down counter 45 of the FIFO memory controller 4 increments its count value, and the memory access request circuit 46 outputs the memory write access request signal 26 to the memory access controller 6. The memory access controller 6 thus executes write access to the image memory 64 similarly as upon writing of video data, and then outputs a one write access end signal 28 to the FIFO memory controller 4. The read counter 43 increments its count value, and the FIFO memory read control circuit 44 updates the value of the FIFO memory read control signal 25.

Then, the up-down counter 45 decrements its count value to update the number of data stored in the FIFO memory 3. When the transfer rate from the CPU is higher than the access rate of the memory access controller 6 to the image memory 64, writing of the CPU write data 13 into the FIFO memory 3 is sometimes put into a waiting condition due to a write upper limit threshold level of the FIFO memory 3.

Figures 5, 6:
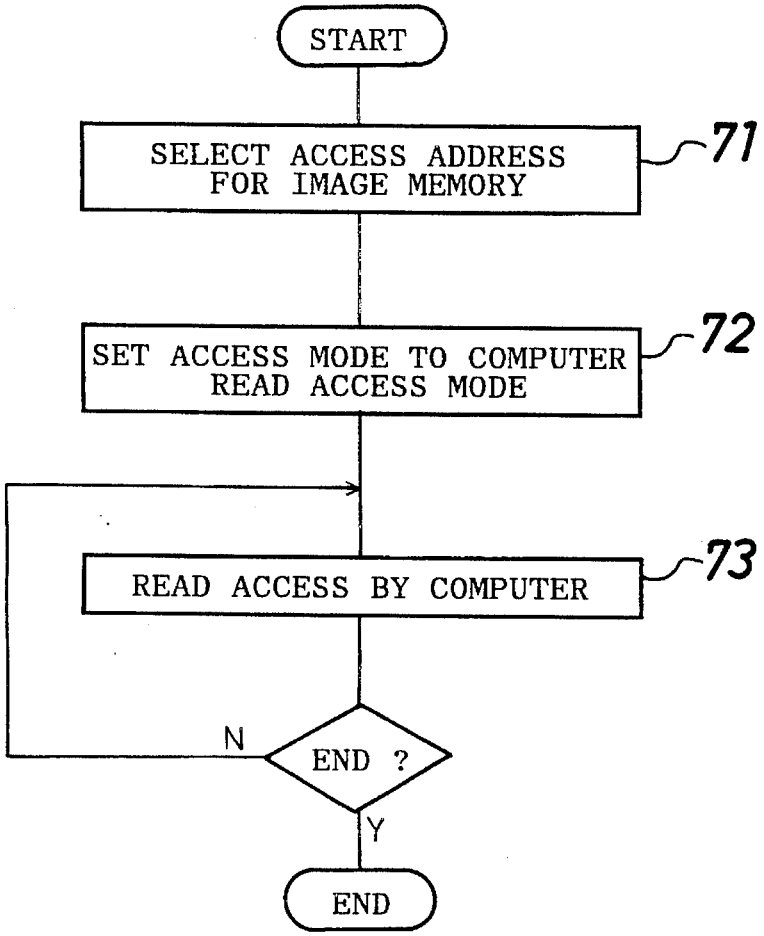
FIG. 5 is a flow chart illustrating operation of a computer of the system shown in FIG. 4 when the computer executes read access.
FIG. 6 is a table illustrating operation conditions of a memory access request signal of the FIFO memory controller of FIG. 2.

Finally, operation of the computer 61 when it reads out data of the image memory 64 will be described. A flow chart of operation of the computer 61 for effectively reading out data of the image memory 64 is shown in FIG. 5. Referring to FIG. 5, the computer 61 places the accessing position of the image memory 64 into the address register 5 (step 71) and then sets the access mode to the image memory 64 to a CPU read access mode (step 72). In this instance, the memory access mode change-over circuit 8 changes over the read/write change-over signal 21 to a read mode and puts the access mode change-over signal 20 into a CPU access mode.

Subsequently, read access is performed actually (step 73). In this instance, the image memory control device 63 executes the following processing until first read access is executed after setting to a computer read access mode.

In particular, the data selector 1 is put into a condition wherein it selects the memory read data 11, and the FIFO memory write request selector 2 is put into a condition wherein it selects the one read access end signal 29 from the memory access controller 6. The FIFO memory controller 4 outputs a memory read access request signal 27 to the memory access controller 6 irrespective of presence or absence of read access from the computer 61.

The memory access controller 6 performs read access to the image memory 64, latches data outputted from the image memory 64, and outputs a one read access end signal 29 to the FIFO memory write request selector 2. Simultaneously, the memory read data 11 is rendered active. The write counter 41 of the FIFO memory controller 4 increments its count value, and the FIFO memory write control circuit 42 outputs the FIFO memory write control signal 24 in accordance with the count value of the write counter 41 to write the write data 23 (in this instance, memory read data 11) into the FIFO memory 3.

Meanwhile, the up-down counter 45 of the FIFO memory controller 4 increments its count value, and the memory access request circuit 46 continuously outputs a memory read access request signal 27 to the memory access controller 6 until the count value of the up-down counter 45 exceeds the data number upper limit value of the FIFO memory 3. The memory access controller 6 executes read access to the image memory 64 so far as the memory read access request signal 27 remains active.

When the computer 61 tries to cause the image memory control device 63 to execute read access to the image memory 64 by way of the bus, the CPU read signal 18 becomes active and the read counter 43 increments its count value, whereafter data are read out from the FIFO memory 3 into the computer 61. Simultaneously, the up-down counter 45 decrements its count value. The memory read access request signal 27 from the FIFO memory controller 4 to the memory access controller 6 sometimes becomes inactive depending upon the upper limit threshold level for the data number of the FIFO memory 3.

Figure 9:
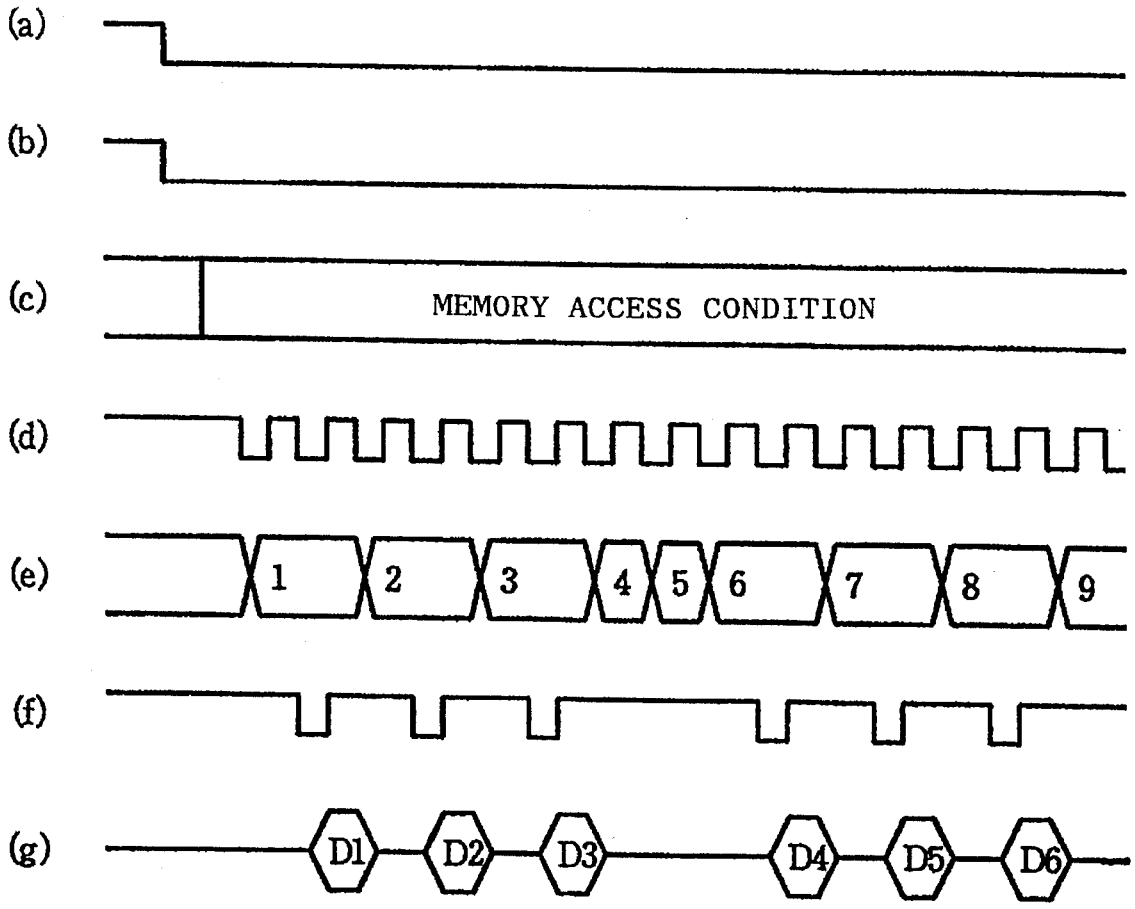
FIG. 9 is a waveform diagram illustrating a reading operation of a CPU of the image memory control device shown in FIG. 1.
Figure 10:
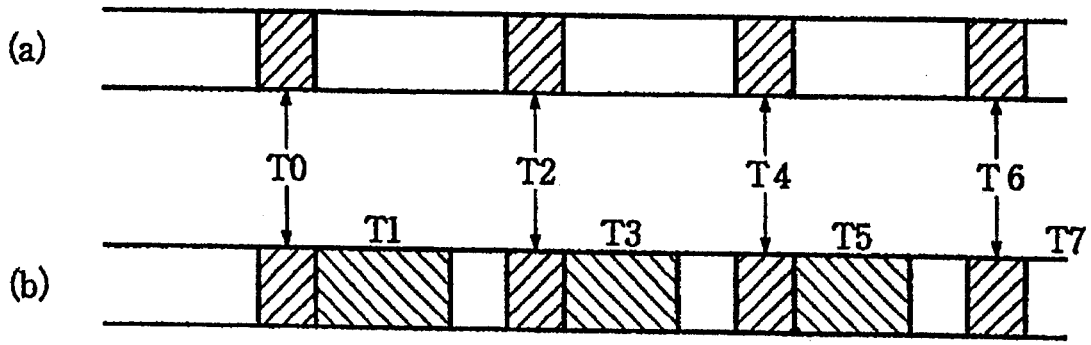
FIG. 10 is a waveform diagram illustrating a reading operation of a CPU of a conventional image memory control device.

An example of operation upon CPU reading is illustrated in FIG. 9. Referring to FIG. 9, the waveform (a) illustrates the CPU read mode; (b) a memory read request; (c) memory access; (d) a write request to the FIFO memory; (e) the number of data in the FIFO memory; (f) reading of the CPU; and (g) data on the computer bus. As seen from FIG. 9, object data are stored into the FIFO memory 3 before read access to the FIFO memory 3 is performed from the computer 61. Further, unless the number of data of the FIFO memory 3 exceeds the upper limit threshold level, the memory access controller 6 continues its reading operation of the image memory 64 in a high speed page mode, and consequently, the computer can execute reading processing at a high speed.

The memory access request signals from the FIFO memory controller 4 to the memory access controller 6 (the memory write access request signal 26 and the memory read access request signal 27) are different depending upon the access mode to the image memory 64 and are such as illustrated in FIG. 6. Writing of video data is performed when the number of data stored in the FIFO memory 3 is not zero, and also write access of the computer 61 is performed when the number of data stored in the FIFO memory 3 is not zero. Further, read access of the computer is performed when the number of data stored in the FIFO memory 3 does not exceed the upper limit threshold level. The number of data stored in the FIFO memory 3 is controlled by the up-down counter 45.

Figure 7:
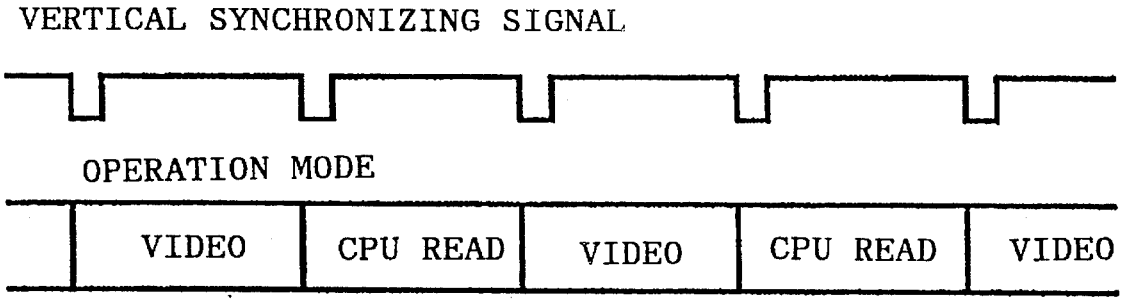
FIGS. 7 and 8 are time charts illustrating different operations for memory access mode changing over.
Figure 8:
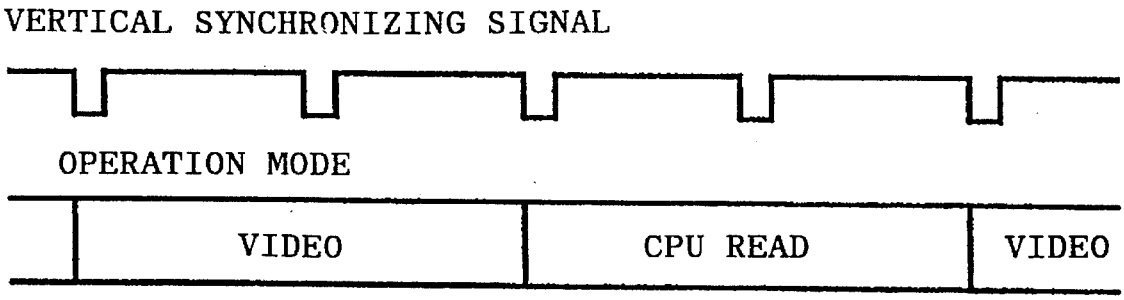

Change-over among a video write mode, a computer write access mode and a computer read access mode is performed using the vertical synchronizing signal 17 as a trigger based on the mode select signal 16 from the computer 61. FIG. 7 illustrates changing over of the access mode in units of a field, and FIG. 8 illustrates changing over of the access mode in units of a frame. Since two or more modes are not present in one period of the vertical synchronizing signal, the FIFO memory 3 can be used in a time dividing condition.

Having now fully described the invention, it will be apparent to one of ordinary skill in the art that many changes and modifications can be made thereto without departing from the spirit and scope of the invention as set forth herein.

What is claimed is:

1. An image memory control device, comprising:

mode change-over means for changing over an access mode to an image memory among a first access mode in which digitized video data are written into said image memory, a second access mode in which image data from a computer are written into said image memory, and a third access mode in which data stored in said image memory are read out in synchronism with a vertical synchronizing signal of a video signal in response to a mode selection signal from said computer;

data select means operable in response to the access mode from said mode change-over means for selecting the digitized video data in the first access mode, selecting the image data from said computer in the second access mode and selecting the data read out from said image memory in the third access mode;

a first-in first-out memory for storing the data selected by said data select means and for successively outputting the stored data in a first-in first-out fashion to said image memory in the first or second access mode but to said computer in the third access mode;

address control means for producing addresses of said image memory for an X direction and a Y direction in accordance with address data received from said computer;

memory access control means for accessing said image memory for data writing operation or data reading operation; and first-in first-out memory control means operable in response to the access mode from said mode change-over means for controlling, in the first access mode, the writing operation and the reading operation of said first-in first-out memory such that the video data selected by said data select means are written into said first-in first-out memory and then successively read out in a first-in first-out fashion from said first-in first-out memory and delivering a write access request to said memory access control means, for controlling, in the second access mode, the writing operation and the reading operation of said first-in first-out memory such that the image data from said computer selected by said data select means are written into said first-in first-out memory and then successively read out in a first-in first-out fashion from said first-in first-out memory and delivering a write access request to said memory access control means and for controlling, in the third access mode, the writing operation and the reading operation of said first-in first-out memory such that the read data from said image memory selected by said data select means are written into said first-in first-out memory and then successively read out in a first-in first-out fashion from said first-in first-out memory.

2. An image memory control device as claimed in claim 1, wherein said first-in first-out control means includes a write counter for controlling the writing position of said first-in first-out memory, a first-in first-out memory write control circuit for producing a write control signal to said first-in first-out memory in accordance with a count value of said write counter, a read counter for controlling the reading position of said first-in first-out memory, a first-in first-out memory read control circuit for producing a read control signal designating the reading position of said first-in first-out memory in accordance with a count value of said read counter, an up-down counter for controlling the number of data stored in said first-in first-out memory, and a memory access request circuit for producing a memory write access request signal or a memory read access request signal to said memory access control means in response to a mode change-over signal from said mode change-over means and a count value of said up-down counter.

3. An image memory control device as claimed in claim 1, further comprising an address register for storing the address data for the Y direction and the X direction outputted from said computer to access said image memory, and wherein said address control means includes a pair of address counters for the Y direction and the X direction, loading control means for loading the address data for the Y direction stored in said address register into said address counter for the Y direction and for loading the address data for the X direction stored in said address register into said address counter for the X direction, counter control means for the Y direction and the X direction for incrementing said address counters for the Y direction and the X direction, respectively, in response to a count-up signal from said memory access control means, and an address selector for selecting one of an address for the Y direction from said address counter for the Y direction and an address for the X direction from said address counter for the X direction.

4. An image memory control device as claimed in claim 3, wherein said address counter for the X direction increments its count value in response to the count-up signal from said memory access control means; said address counter for the Y direction increments its count value upon switching of a horizontal synchronizing signal in the first access mode or when the count value of said address counter for the X direction reaches its final value in the second or third access mode; upon switching of the vertical synchronizing signal, the address data for the Y direction and the X direction are loaded from said address register into said address counters for the Y direction and the X direction, respectively; in the first access mode, the address data for the X direction is loaded from said address register into said address counter for the X direction upon switching of the horizontal synchronizing signal; and in the second mode or the third mode, when the count value of said address counter for the X direction reaches its final value, the address data for the X direction is loaded from said address register into said address counter for the X direction.

* * * * *